United States Patent [19]

Wick et al.

[11] 4,362,197

[45] Dec. 7, 1982

[54] PROCESS FOR SLICING VENEER

[75] Inventors: Charles H. Wick, Woodinville; Stephen J. Suor, Bellevue, both of Wash.

[73] Assignee: Simpson Timber Co., Seattle, Wash.

[21] Appl. No.: 228,131

[22] Filed: Jan. 26, 1981

[51] Int. Cl.[3] ..... B27M 1/00

[52] U.S. Cl. ..... 144/364; 144/380

[58] Field of Search ..... 144/332, 352, 363, 364, 144/369, 380, 177-181, 209 R, 365, 342

[56] References Cited

U.S. PATENT DOCUMENTS 1,025,628 5/1912 Illingworth ..... 144/364

2,615,484 10/1952 Roberge ..... 144/369

3,627,006 12/1971 Swillinger ..... 144/209 R

*Primary Examiner*—W. D. Bray

*Attorney, Agent, or Firm*—Seed, Berry, Vernon & Baynham

[57] ABSTRACT

A novel process for slicing veneer comprises the steps of (1) submerging a piece of lumber in a water bath maintained at an elevated temperature for a period of time sufficient to eliminate excessive curling upon slicing, (2) slicing a single slice of veneer from the lumber, and (3) returning the lumber to the bath for an additional soak period before running the wood through the veneer slicer. Soaking between each slice produces greater uniformity in the slices, which are dried more easily with consumption of less energy.

10 Claims, 2 Drawing Figures

PROCESS FOR SLICING VENEER

DESCRIPTION

TECHNICAL FIELD

This invention relates to a process for uniformly slicing veneer from lumber. The process includes the steps of soaking each piece of lumber for a period of time in a water bath, passing each piece through a slicer, and returning each piece to the water bath for an additional period of soaking before again being passed through the slicer.

BACKGROUND ART

The common method of treating kiln-dried lumber to be sliced into veneer is to immerse the lumber in a pressurized water bath at a temperature of about 140° F. (60° C.). Following this treatment, the lumber is repeatedly passed through a slicer until it has been entirely sliced into veneers. The moisture content of lumber which has been immersed in a pressurized water bath is variable throughout its cross-section, with the outer surface being nearly saturated with water and the inner core relatively dry. Thus the amount of work needed to slice each veneer constantly changes. Drying of each veneer cut from kiln-dried lumber immersed in a pressurized water bath also presents a problem in that a longer drying time is required for each veneer saturated with water cut from the outer surfaces of the kiln-dried lumber in contrast to each veneer of lesser moisture content cut from the inner core areas.

DISCLOSURE OF INVENTION

A novel process for slicing veneer uses a continuous cycling of pieces of kiln-dried lumber through a water bath. Each piece of lumber has at least the face from which a veneer is to be taken soaked in a water bath for a time sufficient to reduce excessive curling of the veneer after slicing. The water bath is maintained at an elevated temperature of at least about 150° F. (65.5° C.). Preferably, the temperature is in the range of between about 160°-190° F. (71°-88° C.), with the most preferred range being about 165°-185° F. (74°-85° C.). To ease handling, the lumber is completely submerged in the water bath. Once soaked, a veneer is cut from the lumber, and then each piece of lumber is returned to the water bath for resoaking.

The sheets sliced with this process can be more uniformly dried than those sliced by prior art processes. Optimal slicing characteristics of the wood are a function of the time of submersion, the temperature of the bath, and the type of lumber being sliced.

BEST MODE FOR CARRYING OUT THE INVENTION

Figure 1:
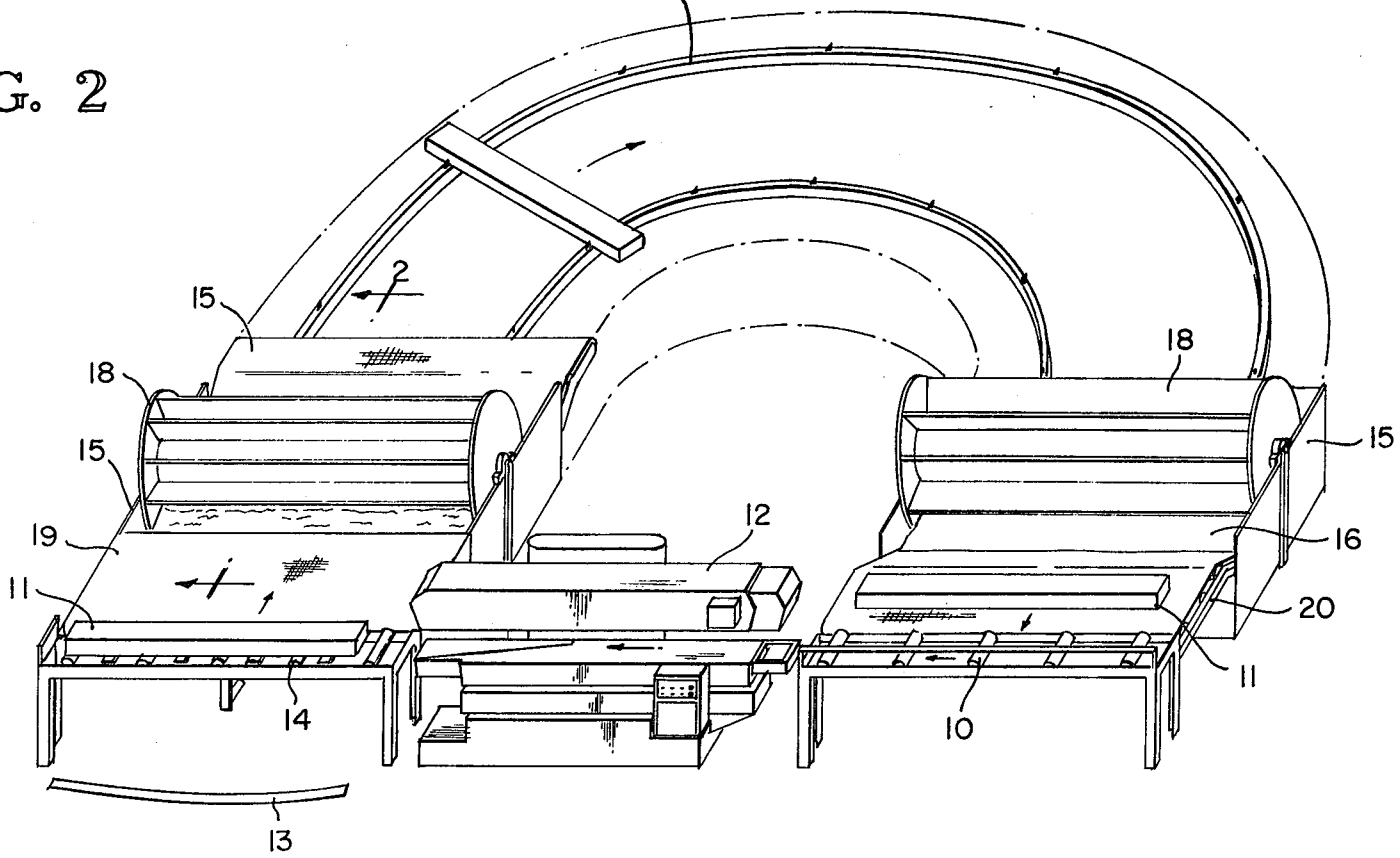
FIG. 1 shows a schematic of the apparatus used in the process of this invention.

A novel process for longitudinally slicing uniform veneers from kiln-dried lumber comprises the steps of soaking the face of the lumber to be sliced in a water bath long enough to eliminate excessive curling of the veneer upon slicing, slicing veneer from the lumber, and resoaking the face of the lumber to be sliced prior to slicing again. As seen in FIG. 1, this process is continuous. A conveyor 10 carries pieces of previously soaked lumber 11 into a slicer 12, such as Single Slicer SL-250, sold by Marunaka Tekkosho, Inc. One veneer 13 is removed. A second conveyor 14 carries the lumber 11 to a water bath 15 in which the piece is submerged. Table 1 shows representative submersion times for cutting uniform veneers with the process of this invention.

TABLE 1

| Type of Lumber | Temp. of Bath °F. | Residence Time in Bath | Thickness of Veneer |
|---|---|---|---|
| Douglas fir | 185° F. | 20 min. | 1/16 in. |
| Hemlock | 165° F. | 5 min. | 1/16 in. |
| Oak | 180° F. | 20 min. | 1/16 in. |
| Redwood | 180° F. | 10 min. | 7/32 in. |

In Table 1, the bath temperatures and the residence times are the minimums generally used to insure that the veneer will not curl excessively upon slicing. The elevated temperature produces better slicing of the lumber. Preferably, the temperature of the water bath is maintained above about 150° F. (65.5° C.). Generally the temperature will be in the range of about 160°-190° F. (71°-88° C.), with the most preferred range being between about 165°-185° F. (74°-85° C.). The quality of the veneer sliced is a function of the type of lumber, the bath temperature, and the residence time in the bath. These three factors interrelate to produce an optimum moisture content at which slicing is smooth and curling of the 1/32-¼ inch veneer is only a minor problem. Those skilled in the art will realize the options available by manipulating these variables. Minimal experimentation should be required in reaching desired working conditions (residence time and bath temperature) for the process for any type of wood.

Another novel feature of this invention is that the lumber is returned for soaking after each veneer is made. The resoaking insures that the moisture content of the face of the wood to be sliced will be more nearly uniform. The slice will also have a temperature approximating that of the bath. In the prior art process of one-step pretreatment of the wood prior to slicing, the heat of the pretreatment in the pressurized water vessel does not penetrate the entire piece during the treatment time; thus the temperature varies for each veneer sliced, making the quality of slices and ease of slicing different.

Figure 2:
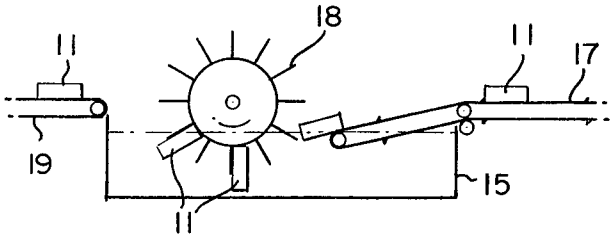
FIG. 2 shows a section through a preferred means to submerge the lumber in a water bath.

FIG. 1 shows two water baths 15 and 16 to treat the lumber 11 in two stages. A conveyor 17 connects the two baths. This split means of soaking is preferred. It reduces the size of the water bath by creating two submersion areas. As seen in FIG. 2, an endless wheel 15, having lateral extending paddles holding the wood, turns to hold each piece underwater as it moves through the bath. The pieces preferably are immersed in the bath with an endless oval belt because such a belt uses the area of the bath more efficiently. More pieces may be immersed at one time. One conveyor 19 dumps the piece into the bath 15 while a second 17 carries it on to the second bath 16. The piece is removed from soaking for only a short time so that any drying is inconsequential. A single immersion of the wood in a water bath functions as well as the two-stage bath; however, the two-stage bath is preferred for ease of construction of the equipment. Additional baths may also be used, if necessary.

The pieces of lumber need not necessarily be submerged. Because slices are taken from only one working face, only that side needs soaking. To float the pieces, however, presents handling problems, especially in regulating the depth of submersion. If the depth is uncontrolled, each slice will differ in moisture content. Therefore, total submersion is highly preferred.

Surfactants may be added to the water bath, if desired, to improve water impregnation into the wood. A suitable surfactant is isopropyl alcohol added to make about a 5% solution. Those skilled in the art will recognize the use of other surfactants as well as their function and utility.

What is claimed is:

1. A continuous process for slicing uniform veneer from kiln-dried lumber, comprising the steps of:

(1) soaking the working face of the lumber to be sliced in a water bath for a sufficient time that a veneer cut therefrom will not curl excessively;

(2) slicing a veneer from the working face of the lumber;

(3) returning the lumber to the water bath to again soak the working face of the lumber; and (4) slicing a second slice of veneer from the working face.

2. The process of claim 1 wherein the water bath is maintained at a temperature of at least 150° F. (65.5° C.).

3. The process of claim 1 wherein the water bath is maintained at a temperature of between about 160°–190° F. (71°–88° C.)

4. The process of claim 1 wherein the water bath is maintained at a temperature of between about 165°–185° F. (74°–85° C.).

5. The process of claim 4 wherein the water bath contains a mixture of water and suitable surfactants.

6. The process of claim 4 wherein the lumber is submerged in the water bath.

7. The process for slicing uniform veneer from kiln-dried Douglas fir lumber, comprising the steps of:

(1) submerging the lumber in a water bath for at least about twenty minutes at a temperature of at least about 185° F. (85° C.);

(2) slicing a veneer from the lumber;

(3) returning the lumber to the water bath for resoaking;

(4) slicing a second veneer from the lumber; and (5) repeating steps (1) to (3).

8. A process for slicing uniform veneer from kiln-dried hemlock lumber, comprising the steps of:

(1) submerging the lumber in a water bath for at least about five minutes at a temperature of at least about 165° F. (74° C.);

(2) slicing a veneer from the lumber;

(3) returning the lumber to the water bath for resoaking;

(4) slicing a second veneer from the lumber; and (5) repeating steps (1) to (3).

9. A process for slicing uniform veneer from kiln-dried oak lumber, comprising the steps of:

(1) submerging the lumber in a water bath for at least twenty minutes at a temperature of at least about 180° F. (82° C.);

(2) slicing a veneer from the lumber;

(3) returning the lumber to the water bath for resoaking;

(4) slicing a second veneer from the lumber; and (5) repeating steps (1) to (3).

10. A process for slicing uniform veneer from kiln-dried redwood lumber, comprising the steps of:

(1) submerging the lumber in a water bath for at least ten minutes at a temperature of at least about 180° F. (82° C.);

(2) slicing a veneer from the lumber;

(3) returning the lumber to the water bath for resoaking;

(4) slicing the second veneer from the lumber; and (5) repeating steps (1) to (3).

* * * * *